US008622371B1

(12) United States Patent
Alenzi

(10) Patent No.: US 8,622,371 B1
(45) Date of Patent: Jan. 7, 2014

(54) ANCHORED AERATOR

(71) Applicant: Bader Shafaqa Alenzi, Abdulla Almubarak (KW)

(72) Inventor: Bader Shafaqa Alenzi, Abdulla Almubarak (KW)

( * ) Notice: Subject to any disclaimer, the term of this patent is extended or adjusted under 35 U.S.C. 154(b) by 0 days.

(21) Appl. No.: 13/961,867

(22) Filed: Aug. 7, 2013

(51) Int. Cl.
*B01F 3/04* (2006.01)

(52) U.S. Cl.
USPC ..... 261/120; 261/121.1; 210/242.2

(58) Field of Classification Search
USPC ..... 261/120, 121.1, 122.1, 124; 210/242.2
See application file for complete search history.

(56) References Cited

U.S. PATENT DOCUMENTS

| | | | | | |
|---|---|---|---|---|---|
| 2,827,268 | A | | 3/1958 | Staaf | |
| 4,216,091 | A | | 8/1980 | Mineau | |
| 4,229,302 | A | * | 10/1980 | Molvar | 210/220 |
| 4,350,648 | A | * | 9/1982 | Watkins et al. | 261/120 |
| 4,581,181 | A | * | 4/1986 | Nicholls | 261/91 |
| 4,906,359 | A | | 3/1990 | Cox, Jr. | |
| 5,565,096 | A | | 10/1996 | Phelan | |
| 5,851,448 | A | * | 12/1998 | Tyer | 261/122.1 |
| 5,938,983 | A | | 8/1999 | Sheaffer et al. | |
| 6,190,544 | B1 | | 2/2001 | Edwards | |
| 6,264,176 | B1 | | 7/2001 | Dickman et al. | |
| 7,520,493 | B1 | * | 4/2009 | Haldane | 261/120 |
| 2002/0063346 | A1 | * | 5/2002 | Lee et al. | 261/120 |
| 2002/0113013 | A1 | * | 8/2002 | Long et al. | 210/620 |
| 2005/0269262 | A1 | * | 12/2005 | McBride | 210/615 |
| 2011/0089098 | A1 | | 4/2011 | Siebert et al. | |
| 2011/0121472 | A1 | * | 5/2011 | Magen | 261/120 |

* cited by examiner

*Primary Examiner* — Charles Bushey
(74) *Attorney, Agent, or Firm* — Richard C. Litman

(57) ABSTRACT

The anchored aerator has a non-buoyant sunken base and a plurality of rigid guide columns extending upward therefrom. A toroidal float is captured between the guide columns, and rises and descends with changes in water level. A down tube passes through the center of the float. A diffuser having a number of radially extending diffuser pipes is installed at the lower end of the down tube. Air is supplied from a remote source, either land-based or based upon a floating vessel. The remote source may supply air to more than one aerator. An air supply line extends from the remote air source to each aerator. Each supply line is supported by one or more rigid columns anchored into the floor of the body of water. The primary aerator structure floats to hold the aerator at a constant level, and is held in position by restraining cables.

15 Claims, 3 Drawing Sheets

ANCHORED AERATOR

BACKGROUND OF THE INVENTION

1. Field of the Invention

The present invention relates generally to liquid aeration systems, and more particularly to an anchored aerator having a sunken base and a plurality of rigid guide columns extending upward therefrom, so that a float is slidably captured between the guide columns and an air diffuser depends from the float to maintain a constant depth below the surface.

2. Description of the Related Art

The contamination of various bodies of water by various means is an increasingly serious problem worldwide. The most widespread contaminants may be organic materials that enter the water system due to pollution from human habitation, either directly or indirectly, e.g., pollution from farms and the like. Such pollution can affect inland fresh water supplies (lakes and rivers), and can also be carried to the sea by inland rivers and waterways or by direct discharge of sewage and/or other pollutants into the sea. Organic material in the sewage of treatment plants is another example of such pollution, although contained for processing. The biochemical processes that occur in water due to such organic pollution are known to decrease the oxygen content of the water, thereby reducing or even destroying fish and other aquatic life in the contaminated body of water. Even if some fish remain in the polluted water, they are almost certainly unfit for human consumption, if caught.

It is generally considered that the most effective means of eliminating such pollutants in contaminated water is by bacteriological processing, wherein bacteria process the contaminants to break them down into harmless organic materials. However, such bacteria are aerobic, i.e., they require oxygen for their metabolism. This is well known in the sewage treatment field, where water is commonly treated by aeration after solids are removed by settling or other means. Such aeration is generally accomplished by mechanical means, e.g., pumping the water up for dispensing into the air from spray booms and nozzles, or by forcing air through underwater pipes for the air to bubble up through the water. Such mechanical systems are relatively costly to operate and require relatively high energy and manpower costs. Even if such systems were less costly to operate, a huge drawback is that they cannot be readily transported to a pollution site for operation at that site. Rather, the water must be transported to the location of the aeration system, a process that is clearly unworkable on a very large scale and/or over very long distances.

Another consideration is the frequent need to position the air diffuser(s) at a constant depth below the surface of the water in which the aerator is installed in order to simplify pressure regulation of the airflow. This is not a significant problem in settling ponds and the like, but can be a significant problem in bodies of water wherein the level changes from time to time, as in reservoirs with controlled outlets and bodies of water influenced by tidal action.

Thus, an anchored aerator solving the aforementioned problems is desired.

SUMMARY OF THE INVENTION

The anchored aerator has a non-buoyant, sunken base that is permanently placed upon the floor of a body of water. A plurality of substantially vertical guide columns extends upward from the base, and a toroidal float is installed and captured between the guide columns. The float is free to float up and down along the guide columns as the water level changes. A down tube or pipe depends through the center of the toroidal float, and moves up and down between the guide columns as the float moves up and down. An aerator assembly comprising a plurality of radial diffuser pipes extends from the lower end of the down tube.

All of the aerators receive their air supply from a remotely disposed air source. The air source may be based on shore, or may be based upon a ship or other floating vessel. A flexible air supply line or hose extends from the air supply to each of the buoyant aerators, the hose being supported by one or more rigid columns or poles anchored into the bottom of the body of water in which the aerators are placed. Since the float remains atop the water, the aeration tubes remain at a constant depth below the surface, so that the air supply remains at a constant pressure with no need for variance. A plurality of such buoyant aerators may be placed in a body of water, all of the aerators receiving their air supply from a single remotely located source.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The anchored aerator receives air from either a land-based or floating vessel-based source. The anchored aerator is secured in the body of water in which it is installed, being anchored to a fixed base set in the floor of the body of water.

Figure 1:
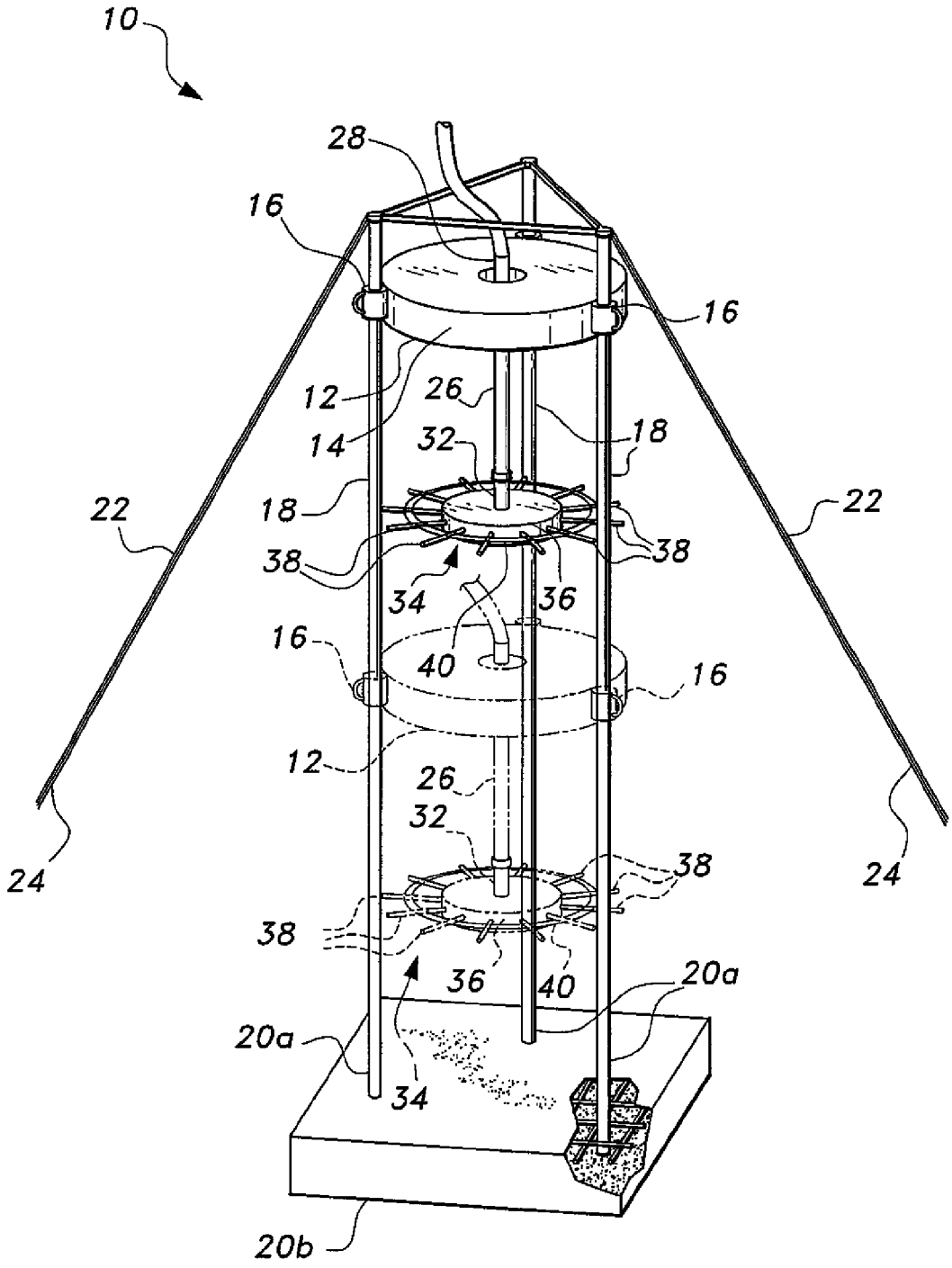
FIG. 1 is a detailed perspective view of an anchored aerator according to the present invention, illustrating various details thereof.
Figure 2:
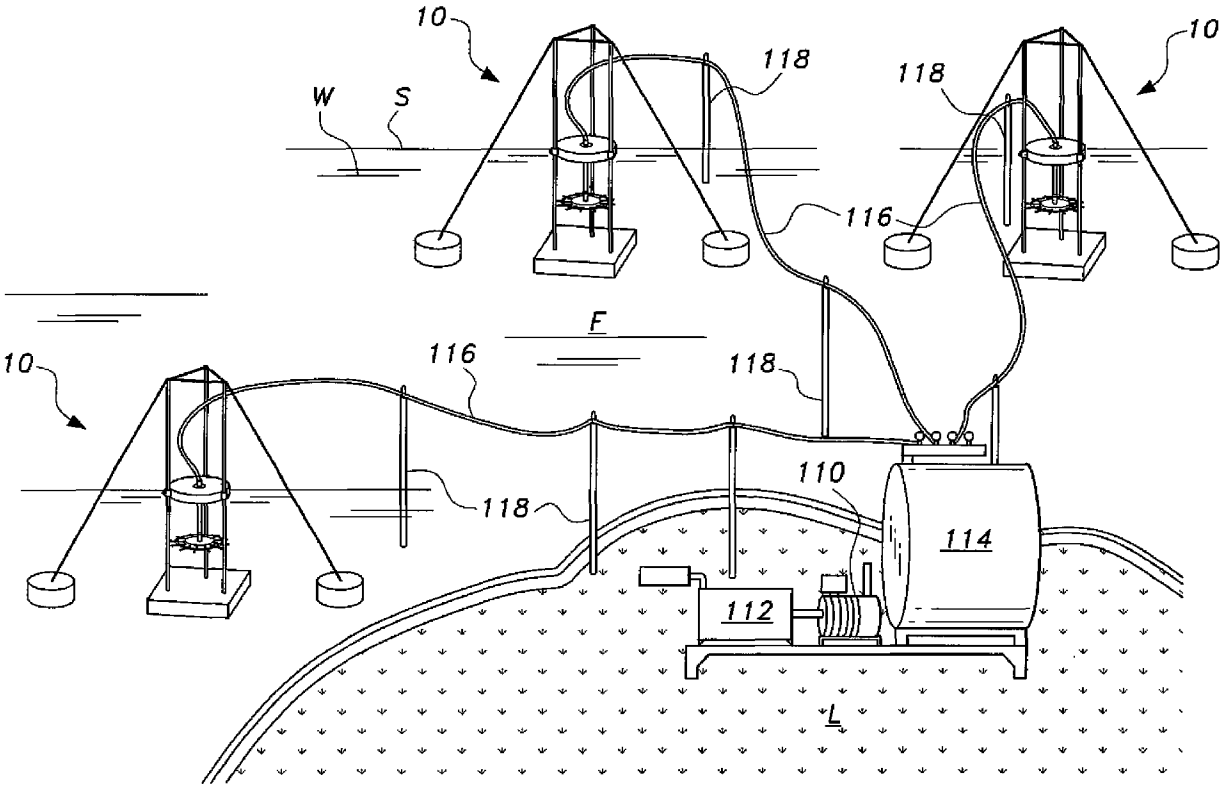
FIG. 2 is an environmental, perspective view of an array of anchored aerators according to the present invention, further illustrating a shore-based air supply.
Figure 3:
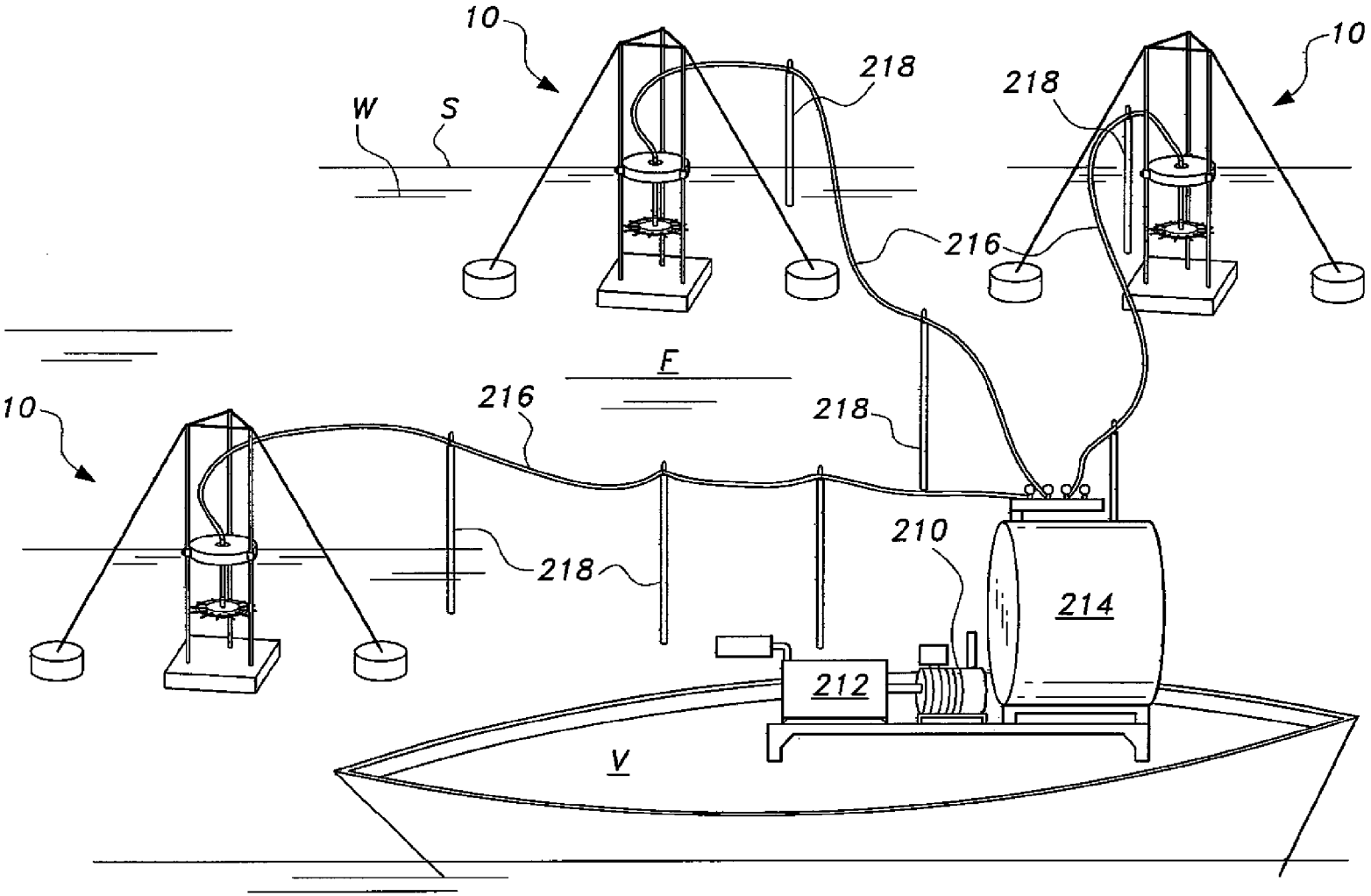
FIG. 3 is an environmental, perspective view of an array of anchored aerators according to the present invention, further illustrating an air supply based upon a floating vessel.

FIG. 1 of the drawings provides a perspective view of an anchored aerator, designated as aerator 10. The aerator 10 has a buoyant toroidal float 12 having a periphery 14 and a plurality of leg attachment passages 16 installed thereon. Corresponding parallel rigid vertical guides 18 have lower ends 20*a* anchored or immovably affixed in a heavy base 20*b* of concrete or the like. The base of the aerator 10 rests immovably upon the floor F of the body of water W, as shown in FIGS. 2 and 3. This structure allows the float 12 to move vertically between the guides 18 as the water level changes, the leg attachment passages 16 sliding vertically along the guides 18. Corresponding anchor cables or lines 22 extend from the leg attachment passages 16. The distal ends 24 of the cables 22 are anchored into the floor F of the body of water W (as in FIGS. 2 and 3) to provide further security for the aerator 10.

The aerator 10 has a single central air delivery column 26 extending substantially vertically through the center hole or passage of the toroidal float 12. The upper end 28 of the column 26 is preferably immovably affixed to the float 12 by suitable conventional braces or the like (not shown) where it passes through the center of the float 12. An aeration outlet 34 is immovably affixed to the lower end 32 of the air delivery column 26, and thus to the remaining structure of the aerator 10. The aeration outlet 34 comprises a relatively flat or thin circular central plenum 36 having a plurality of radially disposed and perforated aeration tubes or nozzles 38 extending therefrom. A circular reinforcement brace 40 is installed concentrically about the plenum 36, tying the aeration tubes 38 together for greater strength.

In FIG. 1, the position of the float 12, air delivery column 26, and aeration outlet 34 are shown with the float positioned near the upper ends of the vertical guides 18 in solid lines, as would be the case with a relatively high water level. If the water level decreases, the float 12 and its attached air delivery column 26 and aeration outlet 34 will descend with the water level, thus lowering the float 12, column 26, and aerator outlet 34 as shown in broken lines in FIG. 1. Since the aeration outlet 34 is immovably affixed to the lower end 32 of the air delivery column 26 and the air delivery column 26 is immovably affixed to the float 12, it will be seen that the aeration tubes 38 remain at a constant fixed depth below the float 12. Thus, as the float 12 rides upon the surface of the water (assuming adequate water depth so that the aeration outlet 34 is not resting upon the anchor base 20*b*), the aeration tubes 38 also remain at a constant fixed depth below the surface of the water. Since this depth is fixed, the water pressure or head at the depth of the aeration tubes 38 is also fixed, thus requiring a constant air pressure from the air supply of either FIG. 2 or FIG. 3. No adjustment of the air pressure is required for the aerator 10 once the pressure has been set.

FIG. 2 of the drawings is a pictorial illustration of a first embodiment of a buoyant aerator array, showing a plurality of anchored aerators 10 receiving their air supplies from a single land-based source. The source of air for the anchored aerators includes a compressor 110 driven by a suitable power source 112 (e.g., gasoline or diesel engine, electric motor, etc.). The compressor 110 delivers air to an air tank 114 to supply the offshore buoyant aerators. The compressor 110, power source 112, and air tank 114 are all installed and based upon the shore or land mass L, clear of the water W. Air is delivered to the various aerators by a separate flexible air delivery line 116 extending from the air tank 114 to each of the aerators, so that each aerator has its own air delivery line 116. Each of the delivery lines 116 is supported above the surface S of the water W by one or more support columns 118. Each of the support columns 118 is immovably affixed and anchored in the underlying land mass L or the floor F of the body of water W.

FIG. 3 of the drawings is a pictorial illustration of a second embodiment of the anchored buoyant aerator array, showing a plurality of anchored buoyant aerators receiving their air supplies from a single floating vessel-based source. The source of air for the buoyant aerators includes a compressor 210 driven by a suitable power source 212 (e.g., gasoline or diesel engine, electric motor, etc.). The compressor 210 delivers air to an air tank 214 to supply the offshore buoyant aerators. The compressor 210, power source 212, and air tank 214 are all installed and based upon the floating vessel V in the water W. Air is delivered to the various aerators by a separate flexible air delivery line 216 extending from the air tank 214 to each of the aerators, so that each aerator has its own air delivery line 216. Each of the delivery lines 216 is supported above the surface S of the water W by one or more support columns 218. Each of the support columns 218 is immovably affixed and anchored in the floor F of the body of water W.

Either of the above embodiments may support an array of buoyant aerators, as shown in FIGS. 2 and 3. While each of those drawings shows only three aerators, it will be understood that more aerators may be supplied by a single air source, depending upon the amount of air used by each aerator and the capacity of the air supply.

It is to be understood that the present invention is not limited to the embodiments described above, but encompasses any and all embodiments within the scope of the following claims.

I claim:

1. An anchored aerator, the aerator being adapted for buoyant placement upon the surface of a body of water, the body of water having a floor and being adjacent to a land mass, the aerator comprising:

a non-buoyant, sunken base;

a plurality of guide columns extending upward from the base;

a toroidal float captured between the guide columns;

an air delivery column disposed substantially vertically and concentrically through the float, the air delivery column having an upper end and an opposite lower end disposed below the float and above the base, the air delivery column being immovably affixed to the float; and an aeration outlet immovably affixed to the lower end of the air delivery column.

2. The anchored aerator according to claim 1, further comprising:

an air supply remotely disposed from the air delivery column; and an air delivery line extending from the air supply to the upper end of the air delivery column.

3. The anchored aerator according to claim 2, further comprising at least one support column supporting said air delivery line, the at least one support column being anchored and immovably affixed to the floor of the body of water.

4. The anchored aerator according to claim 2, wherein:

the air supply is disposed upon the land mass remote from the aerator, the air supply including a compressor, a power source selectively driving the compressor, and an air tank; and the air supply is disposed above the surface of the water and clear of the water.

5. The anchored aerator according to claim 2, further comprising a floating vessel remotely disposed from the aerator, the air supply being disposed upon the floating vessel remote from the aerator, the air supply including a compressor, a power source selectively driving the compressor, and an air tank, the single air supply being disposed above the surface of the water and clear of the water.

6. The anchored aerator according to claim 1, wherein the aeration outlet comprises a plurality of aeration tubes disposed in a radial array and a concentric reinforcement brace connecting the tubes to one another.

7. An anchored aerator array, the array having a plurality of aerators adapted for buoyant placement upon the surface of a body of water, the body of water having a floor and being adjacent to a land mass, each of the aerators of the aerator array comprising:

a non-buoyant, sunken base;

a plurality of guide columns extending upward from the base;

a toroidal float captured between the guide columns;

an air delivery column disposed substantially vertically and concentrically through the float, the air delivery column having an upper end and an opposite lower end disposed below the float and above the base, the air delivery column being immovably affixed to the float; and an aeration outlet immovably affixed to the lower end of the air delivery column.

8. The anchored aerator array according to claim 7, further comprising:

an air supply remotely disposed from the air delivery column of each said aerator; and a plurality of air delivery lines extending from the air supply, each of said aerators having a corresponding one of the air delivery lines connected to the upper end of the air delivery column.

9. The anchored aerator array according to claim 8, further comprising at least one support column supporting each said air delivery line, the at least one support column being anchored and immovably affixed.

10. The anchored aerator array according to claim 8, wherein:

the air supply is disposed upon the land mass remote from the aerator array, the air supply including a compressor, a power source selectively driving the compressor, and an air tank, the single air supply being disposed above the surface of the water and clear of the water; and the air delivery lines extend above the surface of the water from the air supply to said aerators.

11. The anchored aerator array according to claim 8, further comprising a floating vessel remotely disposed from the aerator array, the air supply being disposed upon the floating vessel, the air supply including a compressor, a power source selectively driving the compressor, and an air tank, the air supply being disposed above the surface of the water and clear of the water, the air delivery lines extending above the surface of the water from the air supply to each of the aerators of the aerator array.

12. An anchored aerator, the aerator being adapted for buoyant placement upon the surface of a body of water, the body of water having a floor and being adjacent to a land mass, the aerator comprising:

a non-buoyant, sunken base;

a plurality of guide columns extending upward from the base;

a toroidal float captured between the guide columns;

an air delivery column disposed substantially vertically and concentrically through the float, the air delivery column having an upper end and an opposite lower end disposed below the float and above the base, the air delivery column being immovably affixed to the float;

an aeration outlet immovably affixed to the lower end of the air delivery column;

an air supply remotely disposed from the air delivery column;

an air delivery line extending from the air supply to the upper end of the air delivery column; and at least one support column supporting the air delivery line, the at least one support column being anchored and immovably affixed to the floor of the body of water.

13. The at least one anchored aerator according to claim 12, wherein:

the air supply is disposed upon the land mass remote from the aerator, the air supply including a compressor, a power source selectively driving the compressor, and an air tank, the air supply being disposed above the surface of the water and clear of the water; and the air delivery line extends above the surface of the water from the air supply to the aerator.

14. The at least one anchored aerator according to claim 12, further comprising a floating vessel remotely disposed from the anchored aerator, the air supply being disposed upon the floating vessel, the air supply including a compressor, a power source selectively driving the compressor, and an air tank, the air supply being disposed above the surface of the water and clear of the water, the air delivery line extending above the surface of the water from the air supply to the anchored aerator.

15. The at least one anchored aerator according to claim 12, wherein the aeration outlet comprises a plurality of aeration tubes disposed in a radial array and a concentric reinforcement brace connecting the tubes to one another.

* * * * *